US005493081A

United States Patent [19]

Manigold

[11] Patent Number: 5,493,081

[45] Date of Patent: Feb. 20, 1996

[54] PANEL THAT ABSORBS ACOUSTIC ENERGY AT LOW, MEDIUM AND HIGH FREQUENCIES, PARTICULARLY AT FREQUENCIES RANGING FROM 400 HZ TO 5,000 HZ

[75] Inventor: Alain Manigold, Romanswiller, France

[73] Assignee: Roth Freres, S.A., Strasbourg, France

[21] Appl. No.: 282,460

[22] Filed: Jul. 29, 1994

[30] Foreign Application Priority Data

Aug. 6, 1993 [FR] France ..... 93 09846

[51] Int. Cl.[6] ..... E04B 1/82

[52] U.S. Cl. ..... 181/286; 181/290; 181/294; 428/316.6

[58] Field of Search ..... 181/286, 290, 181/291, 294; 428/309.9, 311.5, 315.7, 316.6

[56] References Cited

U.S. PATENT DOCUMENTS

| | | | |
|---|---|---|---|
| 4,172,918 | 10/1979 | Doerer | 428/316.6 X |
| 4,283,457 | 8/1981 | Kolsky et al. | 181/290 X |
| 4,621,013 | 11/1986 | Holtrop et al. | 428/316.6 X |
| 4,695,501 | 9/1987 | Robinson | 428/316.6 X |
| 5,082,716 | 1/1992 | Satterfield et al. | 428/316.6 X |
| 5,258,585 | 11/1993 | Juriga | 181/286 |
| 5,298,694 | 3/1994 | Thompson et al. | 181/286 |

FOREIGN PATENT DOCUMENTS

| | | |
|---|---|---|
| 0079253 | 5/1983 | European Pat. Off. . |
| 0364102 | 4/1990 | European Pat. Off. . |
| 2639386 | 5/1990 | France . |
| 3212386 | 1/1988 | Germany . |
| 2163388 | 2/1986 | United Kingdom . |

*Primary Examiner*—Khanh Dang
*Attorney, Agent, or Firm*—Young & Thompson

[57] ABSTRACT

A panel absorbing acoustical energy at low, medium and high frequencies, particularly at frequencies ranging from 400 Hz to 5,000 Hz, is essentially constituted by a plate (1) of semi-rigid foam with open communicating cells and by a layer (2) of bonded fibers or by a flexible cellular material. The assembly acts according to a mass-spring principle. The plate (1) of semi-rigid foam with open communicating cells constitutes the mass of the assembly functioning according to the mass-spring principle, while the layer (2) of bonded fibers or of flexible cellular material constitutes the spring of this assembly. The foam comprising the plate (1) is preferably a semi-rigid polyurethane foam of a density ranging from 20 kg/m$^3$ to 50 Kg/m$^3$, of a thickness comprised between 5 mm and 15 mm and whose permeability to air is comprised between 5 liters per minute and 45 liters per minute for a specimen 80 mm in diameter. The layer (2) constituting the spring has a stiffness ranging from 0.007 MPa to 0.05 MPa and a thickness ranging from 4 mm to 10 mm.

9 Claims, 1 Drawing Sheet

PANEL THAT ABSORBS ACOUSTIC ENERGY AT LOW, MEDIUM AND HIGH FREQUENCIES, PARTICULARLY AT FREQUENCIES RANGING FROM 400 HZ TO 5,000 HZ

FIELD OF THE INVENTION

The present invention relates to the field of the production of panels or linings for acoustic absorption, particularly for the provision of roofs of automotive vehicles, and has for its object a panel absorbing acoustical energy at low, medium and high frequencies, particularly at frequencies ranging from 400 Hz to 5,000 Hz.

BACKGROUND OF THE INVENTION

Flat or molded panels, particularly used as the lining of the roofs of automotive vehicles, are generally made from a plate of polyurethane foam with open and connecting cells, of a thickness of 5 mm to 25 mm.

When they are subjected to the action of sound waves, these panels act in the following manner:

- at low and medium frequencies, ranging from 400 Hz to 1,000 Hz, the foam absorbs very little of the sound waves, namely to an extent less than 10%,
- at medium and high frequencies, ranging from 1,000 Hz to 5,000 Hz, the foam strongly absorbs the sound waves, which is to say to an extent comprised between 50% and 70%.

However, for obtaining optimum acoustic comfort in an automotive vehicle, it is necessary that the lining of the roof absorb low, medium and high frequencies ranging from 400 Hz to 5,000 Hz.

To this end, there is known, from FR-A-2 516 034, a roof lining, in which local thin portions are provided at different places on the panel forming the lining, so as to provide cavities, whose bottoms are overlaid with a membrane of a material less permeable to sound.

The assemblies constituted by thinned portions of the roof lining, by membranes and by the layers of air in the cavities, constitute resonances, of a number equal to the number of cavities, these resonances absorbing only low frequencies, over a relatively narrow range.

The lining according to this document FR-A-2 516 034 however has the drawback, on the one hand, of being difficult to commercialize and, on the other hand, of not permitting efficient absorption of low and medium frequencies other than at the location of the thinned regions, such that only a small part of the potentially available surface of the roof lining is used.

Moreover, the medium and high frequencies ranging from 1,000 Hz to 5,000 Hz are not absorbed at these thinned zones.

The present invention has for its object to overcome these drawbacks.

SUMMARY OF THE INVENTION

It thus has for its object a panel absorbing acoustical energy at low, medium and high frequencies, particularly at the frequencies ranging from 400 Hz to 5,000 Hz, characterized in that it is essentially constituted by a plate of semi-rigid foam with open communicating cells and by a layer of bonded fibers or by a flexible cellular material, the assembly functioning as a mass-spring.

BRIEF DESCRIPTION OF THE DRAWINGS

The invention will be better understood from the following description, which relates to a preferred embodiment, given by way of nonlimiting example, with reference to the accompanying schematic drawing, in which.

DETAILED DESCRIPTION OF THE INVENTION

Figure 1:
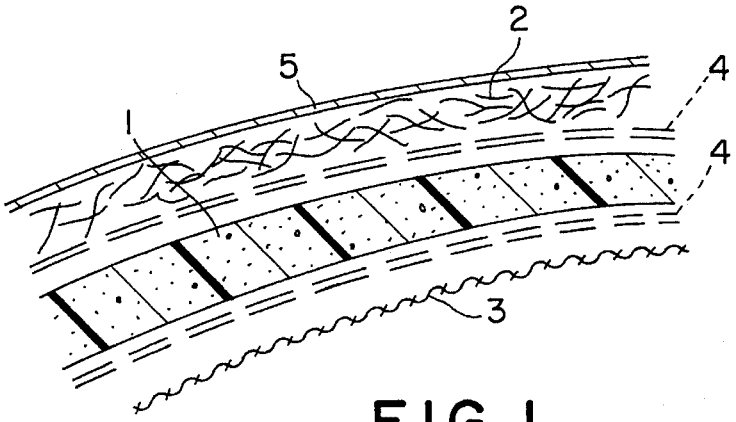
FIG. 1 is a fragmentary side elevational view in cross section of a panel according to the invention.

According to the invention, and as shown in FIG. 1 of the accompanying drawing, the panel absorbing acoustical energy at low, medium and high frequencies, particularly at a frequency ranging from 400 Hz to 5,000 Hz, is essentially constituted by a plate 1 of semi-rigid foam with open communicating cells and by a layer 2 of bonded fibers or by a flexible cellular material, the assembly functioning according to a mass-spring principle.

FIG. 1 of the accompanying drawings shows the use of the panel according to the invention as a roof lining. To this end, the panel is provided with a decorative covering 3 which can be constituted by a non-woven fabric, a jersey or a chain and weft cloth, permeable to air, two sheets of glass fiber 4 being disposed respectively between the covering 3 and the plate 1 of the semi-rigid foam with open communicating cells and between this plate 1 and the layer 2 of bonded fibers or of flexible cellular material, the different layers being interconnected by means of a glue permeable to air, such as a polyurethane glue.

In the panel thus constituted, the plate 1 of semi-rigid foam with open and communicating cells constitutes the mass of the assembly functioning according to the mass-spring principle, while the layer 2 of bonded fibers or of flexible cellular material constitutes the spring of this assembly.

According to one characteristic of the invention, the foam constituting the plate 1 is preferably a semi-rigid polyurethane foam of a density between 20 $Kg/m^3$ and 50 $Kg/m^3$, of a thickness comprised between 5 mm and 15 mm and whose permeability to air is comprised between 5 liters per minute and 45 liters per minute for a specimen 80 millimeters in diameter.

The layer 2 constituting the spring and formed from a sheet of bonded fibers or of a flexible cellular material preferably has, on the one hand, a stiffness ranging from 0.007 MPa to 0.05 MPa, and, on the other hand, a thickness comprised between 4 mm to 10 mm.

According to one characteristic of the invention, the layer 2 forming the spring can be constituted by a cellular material of flexible polyurethane foam, of foam latex rubber or foam rubber.

According to another characteristic of the invention, the layer 2 forming the spring can also be constituted by bonded vegetable or animal or synthetic fibers. Preferably, the layer 2 is constituted by 40% to 80% of fibers of the polyester type having a titre or thread diameter comprised between 4 decitex and 20 decitex, these fibers being associated with thermofusible fibers having a titre comprised between 4 decitex and 20 decitex, these latter fibers being associated in a proportion ranging from 20% and 60%.

The composition of the layer 2 will preferably be 70% polyester fibers having a titre of 6.7 decitex and 30% of thermofusible fibers having a titre of 4 decitex.

The mass-spring assembly formed by the lining according to the invention acts in the following manner:

At high and medium frequencies ranging from 1,000 Hz to 5,000 Hz, the mass formed by the plate 1 of polyurethane foam which is semi-rigid and has open and communicating cells, absorbs in known manner 50% to 70% of the sound waves. However, because on the plate 1 is secured the layer 2 forming a spring, the plate 1 forming the mass behaves, under the simultaneous action of sound waves of a frequency ranging from 400 Hz to 1,000 Hz, on the one hand, and the layer 2 forming the spring, on the other hand, as a vibrating panel, the action of these sound waves giving rise to a flexure of the plate 1 forming the mass simultaneously opposed by the layer 2 forming the spring.

As a result, when the roof lining is subjected to low and medium frequencies, which is to say to frequencies ranging from 400 Hz to 1,000 Hz, the mass constituted by the foam plate 1, starts to vibrate and transforms the acoustical energy into mechanical energy, such that the sound waves are absorbed in a proportion ranging from 30% to 60%. Thus, the roof lining or the panel according to the present invention permits, over all the extent of its surface, an absorption of all the sound waves ranging from 400 Hz to 5,000 Hz by an amount from 30% to 70%.

FIG. 1 of the accompanying drawing shows the use of the panel according to the invention as a roof lining. To this end, the panel is provided with a decorative covering 3 which can be constituted by a non-woven fabric, a jersey or a chain and weft cloth, permeable to air, two sheets of glass fiber 4 being disposed respectively between the covering 3 and the plate 1 of semi-rigid foam with open communicating cells and between this plate 1 and the layer 2 of bonded fibers or of flexible cellular material. These different layers are secured together and shaped by means of a glue permeable to air, such as a polyurethane glue and by compression of this assembly of layers in a die matrix tool of known type mounted on a press. The panel according to the invention, used as a roof lining, is mounted against the steel sheet 5 constituting the roof of an automotive vehicle, the securement of the roof lining with the sheet 5 forming the roof being adapted to be obtained by gluing, clipping or any other mechanical means.

The sound waves directed toward the panel or roof pass through the decorative covering 3 and through the first sheet of glass fibers 4. The mass formed by the plate of polyurethane foam 1 absorbs these sound waves over a range of frequencies ranging from 1,000 Hz to 5,000 Hz, because of its own absorptive properties. However, the sound waves, whose frequency is ranging from 400 Hz to 1,000 Hz cannot be absorbed by the plate of polyurethane foam 1 forming the mass and tending because of this to give rise to a flexure of said plate 1. This flexure is simultaneously opposed by the layer 2 forming the spring, such that there is produced a vibration of the plate 1 forming the mass and hence a transformation of the acoustical energy into mechanical energy having for its result to absorb also the sound waves whose range of frequencies is ranging from 400 Hz to 1,000 Hz.

Figure 2:
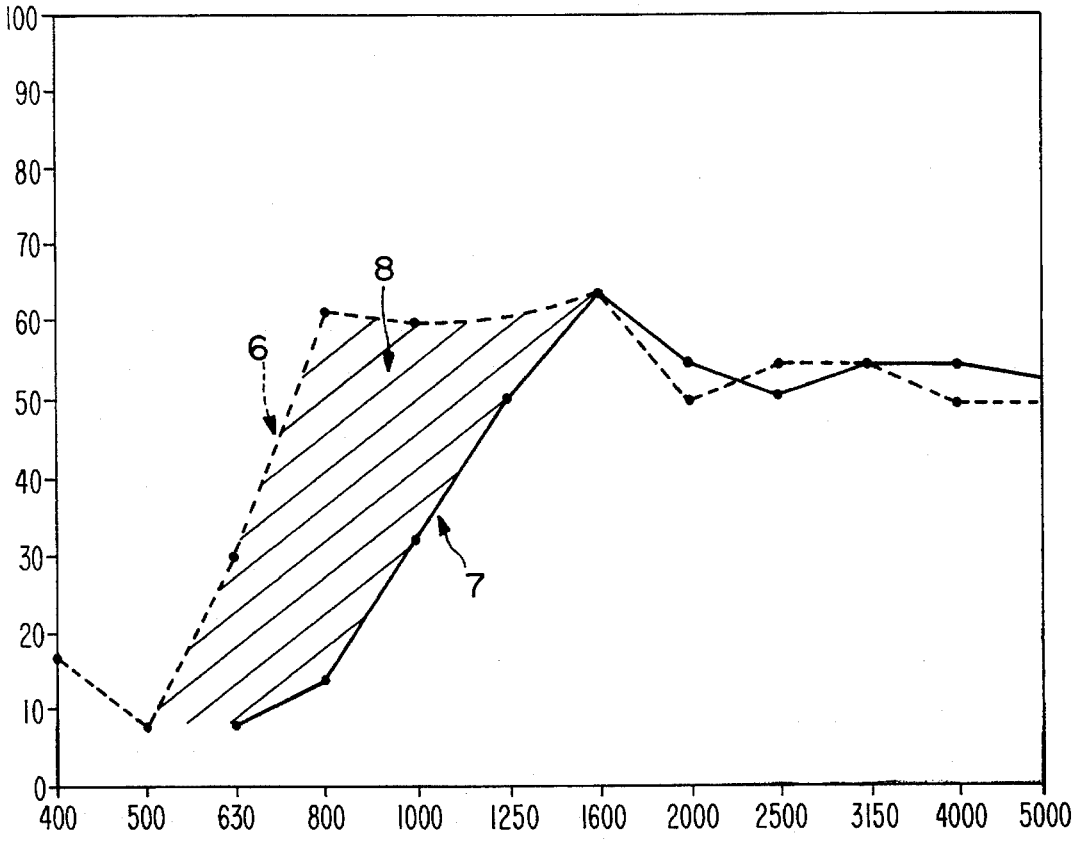
FIG. 2 is a graph showing a sound absorption curve of a lining according to the invention and an analogous curve for a panel of known type.

FIG. 2 of the accompanying drawing is a graphical representation showing the sound absorption curves 6 of a panel forming a roof lining according to the invention and a curve of sound absorption 7 of a panel of known type, in percentage of absorption, as a function of frequency.

As will be seen from a study of this graph, a gain in sound absorption of the panel according to the invention represented by the cross hatched part 8, is enjoyed, in the range of frequency extending more particularly between 400 Hz and 1,000 Hz.

Thanks to the invention, it is possible to provide absorbent panels, for roofs or other flat or molded panels, such as rear plates, door panels, linings, trunk linings, etc . . . , these panels permitting an absorption over a range of frequencies extending from 400 Hz to 5,000 Hz.

Of course, the invention is not limited to the embodiment described and shown in the accompanying drawing. Modifications remain possible, particularly as to the construction of the various elements or by a substitution of technical equivalence, without thereby departing from the scope of protection of the invention.

What is claimed is:

1. A panel absorbing acoustical energy at low, medium and high frequencies ranging from 400 Hz to 5,000 Hz, which comprises a plate (1) of semi-rigid foam with open communicating cells and a layer (2) of bonded fibers or a flexible cellular material superposed on and secured to said plate (1) to form an assembly, the assembly acting according to a mass-spring principle, or wherein the foam of the plate (1) is a semi-rigid polyurethane foam of a density ranging from 20 $Kg/m^3$ to 50 $Kg/M^3$, of a thickness ranging from 5 mm to 15 mm and whose permeability to air ranges from 5 liters per minute to 45 liters per minute for a specimen 80 mm in diameter.

2. A panel according to claim 1, wherein the plate (1) of semi-rigid foam with open communicating cells constitutes the mass of the assembly functioning according to the mass-spring principle, while the layer (2) of bonded fibers or of flexible cellular material constitutes the spring of this assembly.

3. A panel according to claim 1, wherein the layer (2) forming the spring is a cellular material selected from the group consisting of flexible polyurethane foam, latex foam rubber and foam rubber.

4. A panel according to claim 1, wherein the layer (2) forming a spring is bonded fibers.

5. A panel absorbing acoustical energy at low, medium and high frequencies ranging from 400 Hz to 5,000 Hz, which comprises a plate (1) of semi-rigid foam with open communicating cells and a layer (2) of bonded fibers or a flexible cellular material superposed on and secured to said plate (1) to form an assembly, the assembly acting according to a mass-spring principle, or wherein the layer (2) constituting the spring and formed by a sheet of bonded fibers or by a flexible cellular material, has a stiffness ranging from 0.007 MPa to 0.05 MPa and a thickness ranging from 4 mm to 10 mm.

6. A panel according to claim 5, wherein the layer (2) forming the spring is a cellular material selected from the group consisting of flexible polyurethane foam, latex foam rubber and foam rubber.

7. A panel according to claim 5, wherein the layer (2) forming a spring is bonded fibers.

8. A panel absorbing acoustical energy at low, medium and high frequencies ranging from 400 Hz to 5,000 Hz, which comprises a plate (1) of semi-rigid foam with open communicating cells and a layer (2) of bonded fibers or a flexible cellular material superposed on and secured to said plate (1) to form an assembly, the assembly acting according to a mass-spring principle, or wherein said layer (2) is 40% to 80% of polyester fibers having a titre ranging from 4 decitex to 20 decitex, and 20% to 60% of thermofusible fibers having a titre ranging from 4 decitex to 20 decitex.

9. A panel according to claim 8, wherein the layer (2) is about 70% polyester fibers having a titre of 6.7 decitex and about 30% of thermofusible fibers having a titre of 4 decitex.

* * * * *